US005551582A

United States Patent [19]

Robinson

[11] Patent Number: 5,551,582

[45] Date of Patent: Sep. 3, 1996

[54] CHILD RESISTANT TWIST OFF CLOSURE AND CONTAINER

[75] Inventor: Clayton L. Robinson, Newburgh, Ind.

[73] Assignee: Rexam Closures, Evansville, Ind.

[21] Appl. No.: 536,113

[22] Filed: Sep. 29, 1995

[51] Int. Cl.[6] ..... B65D 55/02

[52] U.S. Cl. ..... 215/216; 215/217; 215/225

[58] Field of Search ..... 215/214, 216, 215/217, 218, 219, 221, 223, 224, 225, 321

[56] References Cited

U.S. PATENT DOCUMENTS

| | | | |
|---|---|---|---|
| 3,695,475 | 10/1972 | Ruekberg | 215/217 |
| 3,792,793 | 2/1974 | Rose | 215/221 |
| 3,923,181 | 12/1975 | Libit | 215/216 X |
| 4,298,129 | 11/1981 | Stull | 215/217 X |
| 4,579,239 | 4/1986 | Hart | 215/216 X |

FOREIGN PATENT DOCUMENTS

| | | | |
|---|---|---|---|
| 2515565 | 11/1975 | Germany | 215/216 |

*Primary Examiner*—Allan N. Shoap
*Assistant Examiner*—Nathan Newhouse
*Attorney, Agent, or Firm*—Gifford, Krass, Groh, Sprinkle, Patmore, Anderson & Citkowski, P.C.

[57] ABSTRACT

A child resistant, snap on, twist off closure container package which is open by squeezing and deflecting diametrically opposed side portions of the closure to bring cam followers into engagement which cams on the container so that subsequent turning causes axial displacement and opening movement of the closure from the container. Guide members prevent deforming of the closure to maintain sealing surfaces and adjoining surfaces of the closure and container in alignment with each other and prevent distortion on to expose surfaces which can be gripped by the fingers or teeth in an effort to open the closure and container in a manner other than the intended method of squeezing and twisting of the closure relative to the container.

18 Claims, 2 Drawing Sheets

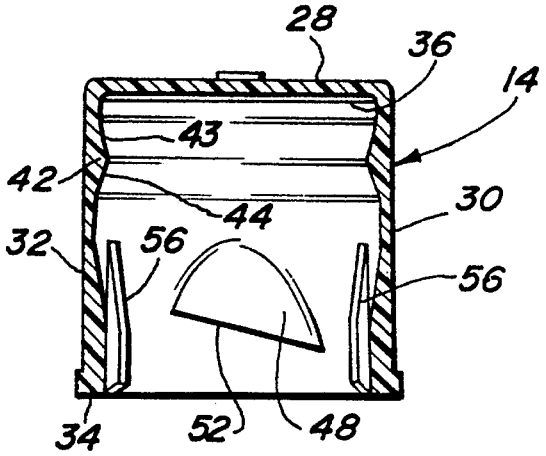
Fig-4
Fig-5
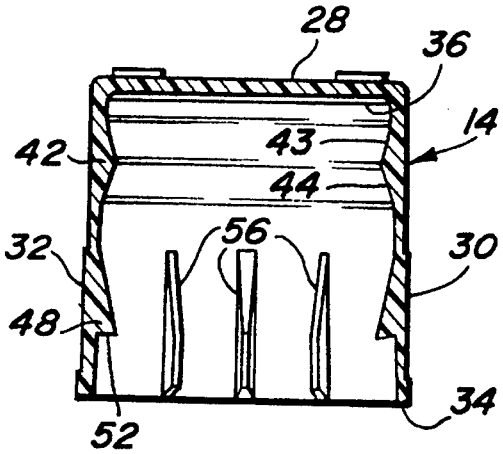
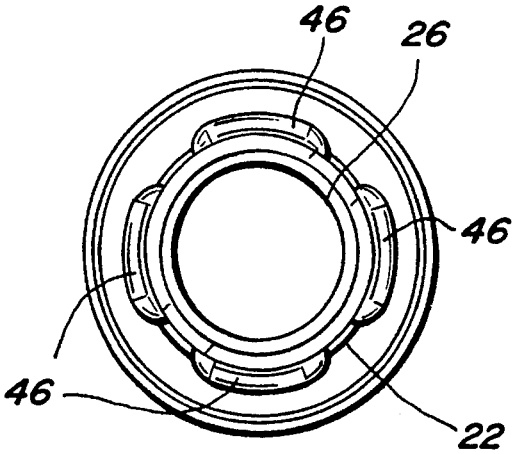
Fig-6
Fig-7
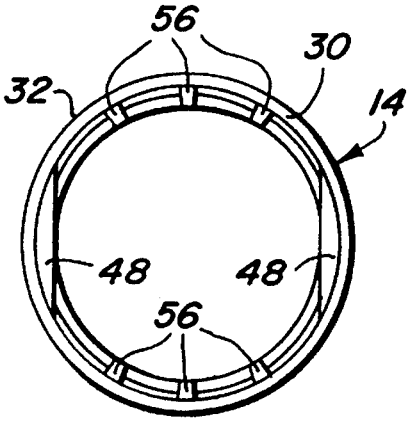

CHILD RESISTANT TWIST OFF CLOSURE AND CONTAINER

This invention relates to child resistant packages and more particularly to packages in which a closure is snapped onto a container to close the package and is twisted off to open it.

Snap on closures of the child resistant type have been provided by which opening is achieved by deflecting diametrically opposed points on the sides of a closure radially inwardly towards each other and subsequently and simultaneously twisting the closure relative to the container to force the closure off of the container. In some of such arrangements the closure can be opened by deflecting the closure at any diametrically opposed points and in still others, the closure must be deflected at a pair of designated diametrically opposed points. With closures of the latter type, it sometimes is possible for the closure and container to become misaligned accidently during shipment in which case complementary sealing surfaces become disengaged and permit leakage of the container contents. In still other instances, misalignment may be caused deliberately in an effort to expose edges or surfaces of the closure that can be engaged by the fingers or teeth of a child to force the closure from the container in a manner not intended.

It is an object of the invention to provide a child resistant closure container package in which the closure can be deflected radially inwardly to produce opening movement only at a pair of predetermined, diametrically opposed locations to avoid misalignment of seals and adjoining portions of the container and closure.

Another object of the invention is to provide a child resistant closure-container package which guide surfaces are provided to prevent axial misalignment of the closure and container to resist opening in a manner other that intended by the child resistant features.

The objects of the invention are accomplished by a closure container package in which opening movement of the container can be accomplished by squeezing and deflecting diametrically opposed portions of the closure radially inwardly to bring cam followers into engagement with cams so that subsequent twisting of the closure relative to the container causes axial displacement which disengages latching surfaces formed on the closure and container so that the closure can be removed. Guide members disposed between the cam followers not only prevent displacement of the closure skirt radially inwardly except at the designated points but also prevent misalignment of the closure and container to maintain sealing surfaces in engagement with each other and maintain adjoining surfaces of the container and closure in alignment with each other to prevent displacement that could form lifting surfaces that might be used to remove the closure in a manner other than that intended by the squeezing and turning action of the closure.

DESCRIPTION OF THE DRAWINGS

FIG. 4 is a cross-sectional view of the closure alone as seen in FIG. 2;

FIG. 5 a cross-sectional view of the closure alone as seen in FIG. 3;

FIG. 6 is a top view of the container with the closure removed; and

FIG. 7 is a bottom view of the closure as shown in FIG. 5.

DETAILED DESCRIPTION

The push on closure container package of the present invention is designated generally at 10 and includes a container 12 and a closure 14.

Figure 2:
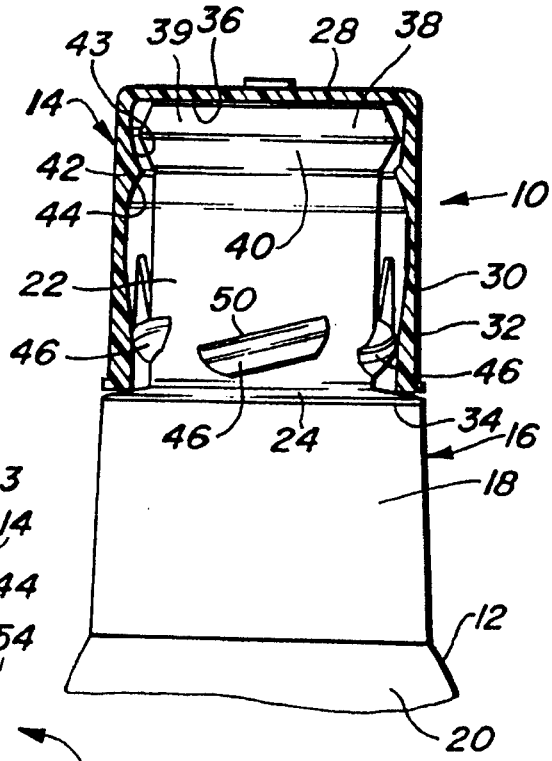
FIG. 2 is an elevation view of the container with the closure shown in cross-section on line 2—2 in FIG. 1.
Figure 3:
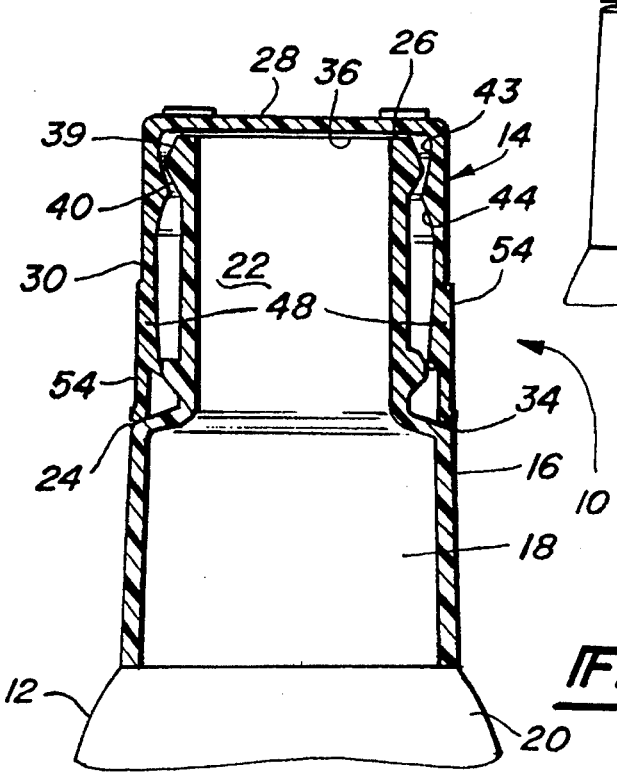
FIG. 3 is an elevation cross-sectional view of the closure and neck of the container taken on line 3—3 in FIG. 1.

The container 12 has an elongated generally stepped, cylindrical neck 16 having a base portion 18 attached to the body 20 of the container 12, as seen in FIGS. 2 and 3. The upper end of the neck 16 has a reduced upper neck portion 22 separated from the base 18 by an annular shoulder 24. The upper end of the upper necks portion 22 is open to provide a dispensing opening for the container and is provided with an annular lip 26 (FIGS. 3 and 6) which forms a sealing surface.

The closure 14 has a disc shaped top 28 and a cylindrical skirt 30 which is coaxial with the neck 16 with the outer wall 32 surface of the skirt 30 in alignment with the outer wall surface of the base portion 18 of the neck 16. In the closed position of the package 10, a lip 34 formed at the bottom of the skirt 30 is in close proximity to the annular shoulder 24 and the outer wall surface 32 of skirt 30 is aligned with the outer wall surface of base portion 18 making it difficult for a child to get a finger hold or to bite the closure in an effort to remove it from the container 12.

The interior of the skirt 30 is in radially spaced relationship to the exterior of the upper neck portion 22 and in the closed position of the package, the underside of the disc shaped top 28 forms a sealing surface 36 engageable with the annular lip 26 to form a seal between the closure 14 and container 12.

The closure 14 is held in a closed position on the container 12 by means of annular bead 38 having an upper inclined surface 39 and a lower inclined surface 40 formed on the exterior of the neck 16 adjacent to the annular lip 26. A complementary annular bead 42 is formed on the interior of the skirt 30 adjacent to the disc shaped top 28. The annular bead 42 has an upper inclined surface 43 and a lower inclined surface 44. The outside diameter of the annular bead 38 is slightly larger than the internal diameter of the annular bead 40 so that there is an interference fit between the beads 38 and 40 which resists axial movement of the closure 14 relative to the neck 16. This affords a resilient snap-fit which occurs when the closure 14 is placed on the container 12 and which must be overcome to open the container 12 so that the closure can be removed from the container 12. In this sense, beads 38 and 42 form latch members which must be disengaged to open the container. Also, the lower inclined surface 39 on bead 38 and upper inclined surface 43 on bead 42 engage each other in a closed position of the package 10 to form a seal in addition to the sealing surfaces 26 and 36.

Disengagement of the latch members formed by beads 38 and 42 is accomplished by a camming arrangement which includes a plurality of circumferentially spaced cams 46 best seen in FIGS. 2 and 6 formed on the exterior of the upper neck 22 and a pair of diametrically opposed cam followers 48 seen in FIGS. 4 and 7 and formed in diametrically opposed relation on the interior of the cylindrical skirt 30. The cams 46 have an upper inclined surface 50 as seen in FIG. 2 and are arranged in slightly spaced circumferential relationship to each other. In the illustrated embodiment of the invention four cams 46 are shown although more or less cams could be similarly arranged.

Cam followers 48 seen in FIG. 4 have a inclined surface 52 at the lower side which conforms generally to the upper surface 50 of the cams 46. The inclined surfaces 52 of the cam followers 44 extend radially inwardly from the inner wall surfaces of the skirt 30 and taper axially and circumferentially to blend with the inner wall surfaces of the skirt 30. In a closed condition of the closure 14 on the container 12, the cam followers 48 are radially misaligned with the cams 46 so that the closure 14 can be rotated relative to the neck 16 without any interferences between the cams 46 and the cam followers 48. Such misalignment also permits axial movement of the closure relative to the container 12 without any interference when the closure 14 is first snapped on to the container 12.

Figure 1:
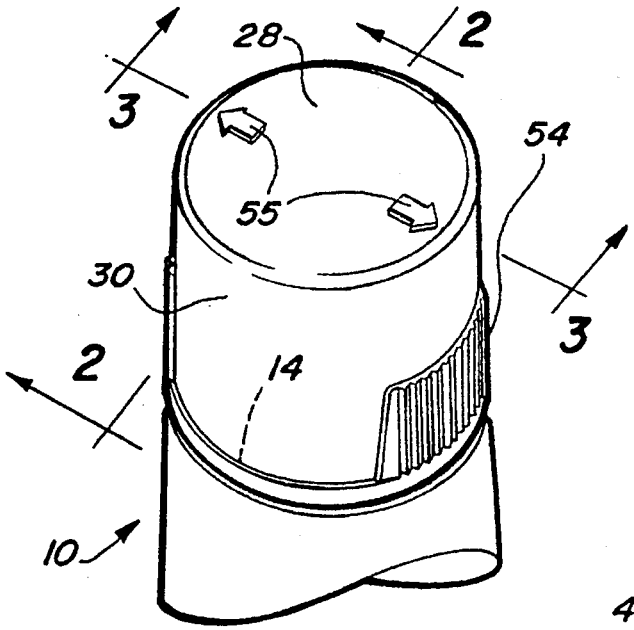
FIG. 1 is a perspective view of the closure on a container embodying the invention in which only a portion of the container is shown.

Pressure points or pads 54 are formed opposite to the cam followers 48 on the outer surfaces of the skirt 30, as seen in FIGS. 1 and 3, which give a ready reference to the areas at which pressure must be applied to deflect the skirt 30 radially inwardly to bring the cam followers 48 into circumferential alignment with the cams 46. The disc shaped top 28 is provided with arrows 55 or other indicia to give visual and printed instructions for opening. Simultaneous with the application of pressure to pads 54, twisting movement of the closure 14 in an opening direction will cause the inclined surfaces 52 on the cam followers 48 to engage with the upper surfaces 50 on the cams 46 so that the closure 14 is forced axially of the container 12 a sufficient distance so that the annular beads 38 and 42 unsnap or become disengaged from each other permitting removal of the closure 14 from the container 12.

In a closed condition of the container 12 by the closure 14, the closure skirt 30 is in radially spaced relationship to the outer surface of the neck portion 22 and with the closure in axial alignment with the neck 16, the sealing surface 36 on the closure 14 is seated on the annular lip seal 26 at the top of the neck portion 22. Also the lip 34 at the lower end of the skirt 30 is in close proximity with the annular shoulder 24 and the exterior walls of the skirt 30, the base portion 18 of the neck 16 are aligned to give a smooth outer surface. To maintain this relationship, the inner surface of the skirt 30 is provided with guide members 56 in the form of ribs which extend generally axially and are disposed in circumferencially spaced and aligned relationship to each other and the cam followers 48. In the preferred embodiment, three ribs 56 are disposed in each of the diametrically opposed spaces between the cam followers 48. As best seen in FIG. 7, the guide members 56 are circumferencially spaced from each other in an amount substantially equal to the spacing of the ribs 56 from the cam followers 48. The guide members or ribs 56 are disposed to project radially inwardly an amount equal to the radial inward projection of the cam followers 48 so that the ribs 56 are in spaced but close proximity to the cams 46 and the closure 14 is free to be rotated relative to the container 12 without interference in the closed condition of the package. Similarly, the guide members 56 are disposed so that they do not interfere with placement of the closure 14 on the closure to obtain the snap connection between the annular beads 38 and 40 which maintains the closure on the container 12.

Any effort, deliberate or accidental, which would tend to displace the skirt 30 radially relative to the neck 16, is opposed by the guide members 56 which will engage the sides of the cams 46. This prevents axial misalignment of the closure 14 so that the complementary seals 26 and 36 on the container 12 and the closure 14, respectively, is resisted. Also by maintaining the axial alignment of the closure 14 and the container 12, the lip 34 of the skirt is maintained in its proper uniformly spaced and aligned relationship to the annular shoulder 24 so that no portion of the lip 34 is exposed and leverage cannot be obtained by the use of fingers or teeth to remove the cap except in its intended manner.

During placement of the closure 14 on the container 12, the upper inclined surface 39 of the annular bead 38 acts to engage and align internal portions of the closure 14 so that the cam followers 48 and guide members 56 are free to pass to their closed position. Just prior to the closed position the inclined lower surface 44 of the bead 42 comes into engagement with the upper inclined surface 39 of the annular bead 38. The plastic materials of the closure and container 12 permits sufficient deflection so that the bead 42 passes beyond the annular bead 38 with the lower inclined surface 40 of the annular bead 38 and the upper inclined surface 43 of the bead 42 engaged with each other to act as a seal and also to resist axial opening movement of the closure 14 from the container 12. These surfaces remain in engagement with each other during any rotation of the closure relative to the container 12. During such rotation the guide members 56 and the cam followers 46 are free to pass the cams 46 and to prevent tilting of the closure relative to the. Any effort to deflect the skirt 30 of the closure 14 radially inwardly is opposed by the guide members or ribs 56 so that radial deflection of the skirt 30 is possible only at the location of the cam followers 48.

To remove the closure 14 from the container 12, pressure is applied simultaneously to diametrically opposed pressure points 54 causing radial inward deflection of the skirt 30 together with the cam followers 48. The cam followers 48 are brought into overlapping relationship with the cams 46 and upon simultaneous twisting action of the cap in an opening direction, the inclined surfaces 50 and 52 engage each other to force the closure and axially apart so that the annular beads 38 and 40 unsnap relative to each other permitting a full release of the closure 14 from the container 12.

A snap on, twist off child resistant closure has been provided which permits rotation of the closure relative to the container in a closed condition and which requires simultaneous squeezing and twisting for opening to occur. During any relative movement of the closure and container, axial alignment is maintained so that forceful opening is resisted and so that sealing surfaces remain properly oriented.

I claim:

1. A child resistant container and closure package comprising;

a hollow cylindrical neck forming part of said container;

a cylindrical skirt forming part of said closure and being disposed coaxially with and in radially spaced relation to said neck in a closed condition of said package;

latch members formed on said skirt and neck and being engageable with each other to form a snap connection resiliently resisting axial opening movement of said closure from said container;

a plurality of cam elements arranged circumferentially on the exterior of said neck and below said latch members;

a pair of diametrically opposed cam followers formed on the interior of said skirt and in radially spaced relation to said cam elements to permit axial placement of said closure on said container without interference and to permit relative rotation of said closure and container in a closed condition of said package;

guide members formed on the interior of said skirt between said cam followers and in close proximity to said cam elements to permit free rotation of said closure relative to said neck and to engage said cam elements to resist tilting of said closure relative to said neck; and said skirt being deflectable radially inwardly only at diametrically opposed portions on said skirt opposite to said cam followers to move said cam followers radially inwardly into overlapping relation to said cam elements whereby simultaneous opening rotation of said closure relative to said container moves said closure axially of said container to disengage said latch members for removal of said closure.

2. The combination of claim 1 wherein said guide members are axially extending ribs.

3. The combination of claim 2 wherein said guide members have an axial height at least equal to the axial height of said cam elements.

4. The combination of claim 2 wherein a plurality of said ribs are disposed between said cam followers.

5. The combination of claim 1 wherein pressure points are formed on the exterior of said skirt opposite to said cam followers.

6. The combination of claim 5 wherein deflection of said skirt upon applying force to said pressure points results in radial outward deflection of said skirt in the area of said guide members.

7. The combination of claim 1 wherein latch members are formed by continuous annular beads on said neck and on said skirt.

8. The combination of claim 4 wherein said plurality of guide members are equally spaced from each other and from said cam followers.

9. The combination of claim 2 wherein said guide members resist radial inward deflection of said skirt except at said pressure points.

10. A snap on, child resistant closure and container the combination of:

a neck forming part of said container and having a cylindrical wall with an open end forming a sealing surface;

a disc shaped top forming part of said closure and having a cylindrical skirt depending therefrom and disposed coaxially of and in axially spaced relation to said cylindrical wall, said top having an annular sealing portion in sealing relation to said sealing surface of said neck;

a first latch member formed on the exterior of said neck and a second latch member formed on the interior of said cylindrical skirt for engagement with each other in a snap fit relation to resiliently retain said closure on said container;

a plurality of cam elements in circumferentially and uniformly spaced relation to each other on the exterior of said neck;

a pair of diametrically opposed cam followers on the interior of said skirt in radially spaced relation to said cam elements to permit relative rotation of said closure and neck, said skirt being deflectable radially inwardly at points adjacent to said cam followers to bring said cam followers into engagement with said cam elements to force said closure axially of said neck to disengage said latch members from each other upon opening rotation of said closure; and guide members formed on the interior of said skirt in substantially circumferential alignment with said cam followers and in close proximity to said cam elements, said cam followers and guide members being engageable with the outer surfaces of said cam elements and prevent axial misalignment of said closure on said neck to maintain said sealing surface on said neck in sealing relation to said annular sealing portion of said top.

11. The combination of claim 10 wherein said first and second latch members are annular rings complementary to each other.

12. The combination of claim 11 wherein said annular rings form sealing surfaces in engagement with each other.

13. The combination of claim 10 wherein said guide members are disposed between said cam followers.

14. A twist off, child resistant closure container package comprising:

a container having a cylindrical neck with a lower base portion and upper neck portion forming an annular shoulder therebetween and an upper annular lip on said upper neck portion forming a first sealing surface;

a closure having a top forming a second sealing surface complementary to said first sealing surface and a cylindrical skirt extending from said top coaxially with said neck, said skirt having a lower lip in close proximity to said annular shoulder and having an outer surface in substantial alignment with said base portion of said neck;

complementary annular latch members formed on said upper neck portion and said skirt to maintain said closure in a resiliently and axially latched condition;

a plurality of cams formed on the exterior of said upper neck portion;

a pair of cam followers in diametrically opposed relation on the interior of said skirt in radial misalignment with said cams to permit unobstructed relative rotation of said closure and neck, said cam followers being deflectable radially inward with said skirt to align said cams and cam followers so that simultaneous relative twisting of said closure relative to said neck forces said closure axially to disengage said latch members; and guide elements disposed between said cam followers in annular alignment on the interior of said skirt and in radially spaced but close proximity to said cams for engagement with the sides of said cams to maintain axial alignment of said neck and skirt to prevent separation of said sealing surfaces and to maintain said lower lip of said closure in close proximity and alignment with said shoulder on said neck.

15. The combination of claim 14 wherein said latch members are complementary annular rings on said upper neck portion and said skirt forming a seal between said closure and container.

16. The combination of claim 14 wherein said guide elements are axially extending ribs.

17. The combination of claim 16 wherein a plurality of said ribs are disposed between said cam followers.

18. The combination of claim 14 wherein finger pressure points are formed on the exterior of said cylindrical skirt opposite to said cam followers on the interior of said skirt.

* * * * *